US007644872B2

(12) United States Patent
Lang et al.

(10) Patent No.: US 7,644,872 B2
(45) Date of Patent: Jan. 12, 2010

(54) POWDER PORT BLOW-OFF FOR THERMAL SPRAY PROCESSES

(75) Inventors: Thomas E. Lang, Lebanon, ME (US); Christopher W. Strock, Kennebunk, ME (US)

(73) Assignee: United Technologies Corporation, Hartford, CT (US)

( * ) Notice: Subject to any disclaimer, the term of this patent is extended or adjusted under 35 U.S.C. 154(b) by 524 days.

(21) Appl. No.: 11/387,652

(22) Filed: Mar. 23, 2006

(65) Prior Publication Data

US 2007/0221751 A1 Sep. 27, 2007

(51) Int. Cl.
*B05C 5/04* (2006.01)

(52) U.S. Cl. ..... 239/84; 239/79; 239/106; 219/76.11; 219/76.16; 219/121.5

(58) Field of Classification Search ..... 239/84, 239/104, 106, 120; 219/76.11, 76.14, 76.16, 219/121.47

See application file for complete search history.

(56) References Cited

U.S. PATENT DOCUMENTS

| | | | | |
|---|---|---|---|---|
| 2,262,964 | A * | 11/1941 | Reilly et. al. | 239/83 |
| 4,146,654 | A * | 3/1979 | Guyonnet | 427/451 |
| 4,741,286 | A | 5/1988 | Itoh et al. | |
| 5,013,883 | A * | 5/1991 | Fuimefreddo et al. | 219/121.47 |
| 5,047,612 | A | 9/1991 | Savkar et al. | |
| 5,340,023 | A * | 8/1994 | Itoh et al. | 239/13 |
| 5,408,066 | A * | 4/1995 | Trapani et al. | 219/121.47 |
| 5,858,470 | A * | 1/1999 | Bernecki et al. | 427/453 |
| 5,932,356 | A | 8/1999 | Sileo et al. | |
| 6,355,356 | B1 | 3/2002 | Hasz | |

FOREIGN PATENT DOCUMENTS

| | | | |
|---|---|---|---|
| EP | 1075167 | A | 2/2001 |
| EP | 0457067 | A2 | 3/2008 |
| WO | 2006080870 | A1 | 8/2006 |

* cited by examiner

*Primary Examiner*—Dinh Q Nguyen
(74) *Attorney, Agent, or Firm*—Kinney & Lange, P.A.

(57) ABSTRACT

A powder port blow-off system for a plasma spray process includes a faceplate that includes a bore therein that is co-radially aligned with a nozzle of a plasma spray gun, which emits a plasma plume. A plurality of powder feed ports are arranged circumferentially around the nozzle for injecting a flow of powder particles toward the plasma plume. A plurality of powder port blow-offs are arranged circumferentially around the nozzle in order to direct blow-off gas across the powder feed ports. The powder port blow-offs are directed across the plasma plume to create a vortex for carrying away powder particles unconsumed by the plasma plume.

19 Claims, 2 Drawing Sheets

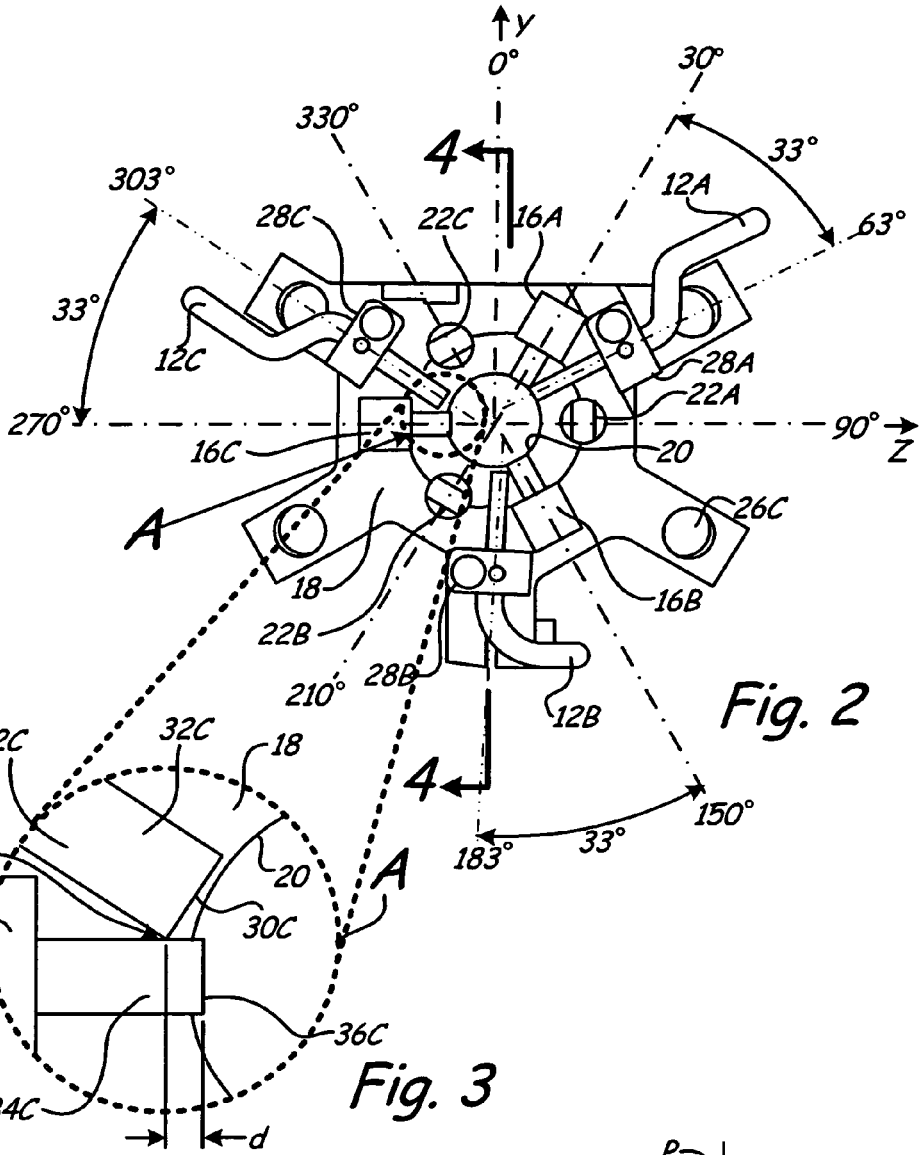
Fig. 2
Fig. 3
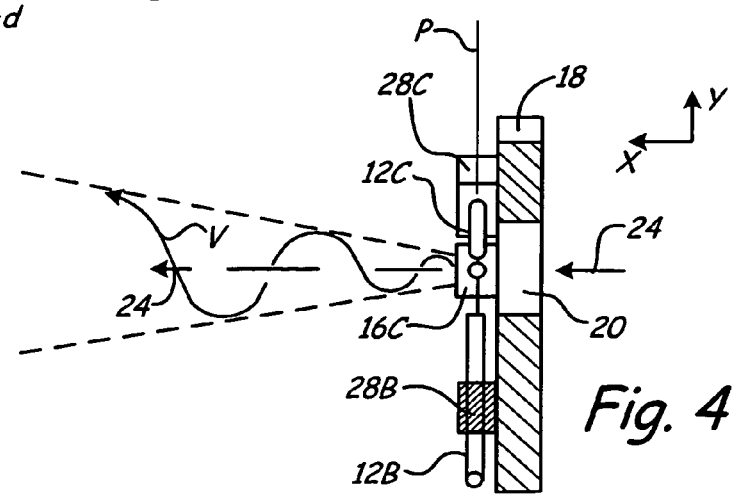
Fig. 4

POWDER PORT BLOW-OFF FOR THERMAL SPRAY PROCESSES

BACKGROUND OF THE INVENTION

This invention relates generally to thermal spray processes and more particularly to powder port blow-offs for plasma spray faceplates. In plasma spray processes, a plume of plasma is used to apply a coating material to a substrate. The plasma plume is created by passing a gas such as nitrogen through an electric arc, which creates a very high temperature stream of plasma, which is then directed toward the substrate. The coating material is injected into the plasma stream typically in the form of a powder near the plasma source. The powder is melted and projected towards the substrate thereby forming a layer of the sprayed material on the substrate.

The powder is typically injected into the plasma stream by one or more powder ports mounted on a faceplate radially around the circumference of an opening, or nozzle, from which the plasma plume is emitted. In other embodiments, powder ports are arranged in a semi-radial configuration in which the powder ports are inclined forward or rearward with respect to the plasma plume. During the thermal spray process, powder coating material inherently accumulates on the faceplate, including the nozzle. Particularly when multiple powder ports are employed, it is typical that the powder streams foul up opposing powder ports. Therefore, powder port blow-offs are used to blow powder not consumed in the plasma plume into the surrounding air, whereby it can be collected by air filters. Powder port blow-offs are typically located near the powder ports, and comprise nozzles that project a jet of air towards the plasma plume.

Nonetheless, powder still accumulates on the faceplate, powder ports and blow-offs. Additionally, in previous powder port blow-off designs, the powder ports were directed inward toward the faceplate. This resulted in blow-back of powder coating material onto the faceplate, instead of being directed away from it. Accumulated powder on the faceplate or other components requires intermittent shutdowns of the coating process so the powder ports, blow-off nozzles and faceplate can be cleaned, which slows production rates. Additionally, the stoppages require that the plasma gun and powder feeders be shut down and restarted more often, which wastes expensive powders, gasses, and electricity; and reduces plasma spray gun component life. With previous blow-off designs, shutdowns may be required as often as every ten spray cycles. With some parts requiring as many as seventy spray cycles to completely coat all components of the part, that is far too many shutdowns. Therefore, there is a need for a more effective powder port blow-off system that results in fewer production stoppages.

BRIEF SUMMARY OF THE INVENTION

The present invention is directed toward a powder port blow-off system for plasma spray coating systems. Embodiments of the powder port blow-off system include a faceplate, at least one powder feed port, a thermal spray gun, and at least one powder port blow-off. In embodiments, there are multiple powder feed ports and multiple powder port blow-offs, and the thermal spray gun is a plasma spray gun. The faceplate typically includes a nozzle capable of emitting a plasma plume toward a part, the powder feed ports for injecting a flow of powder particles toward the plasma plume, and the powder port blow-offs for keeping the system clean. The plurality of powder port blow-offs are preferably arranged circumferentially around the plasma nozzle in order to direct blow-off gas across the powder feed ports. The powder port blow-offs are also directed across the plasma plume, and create a vortex for carrying away powder particles unconsumed by the plasma plume.

BRIEF DESCRIPTION OF THE DRAWINGS

FIG. 2 is a front view of the faceplate of FIG. 1 showing the arrangement of the powder port blow-offs.

FIG. 3 is a close-up of region A of FIG. 2 showing the powder port blow-off arrangement.

FIG. 4 is cross-section 4-4 of FIG. 2 showing the in-plane configuration of the powder port blow-offs.

DETAILED DESCRIPTION

Figure 1:
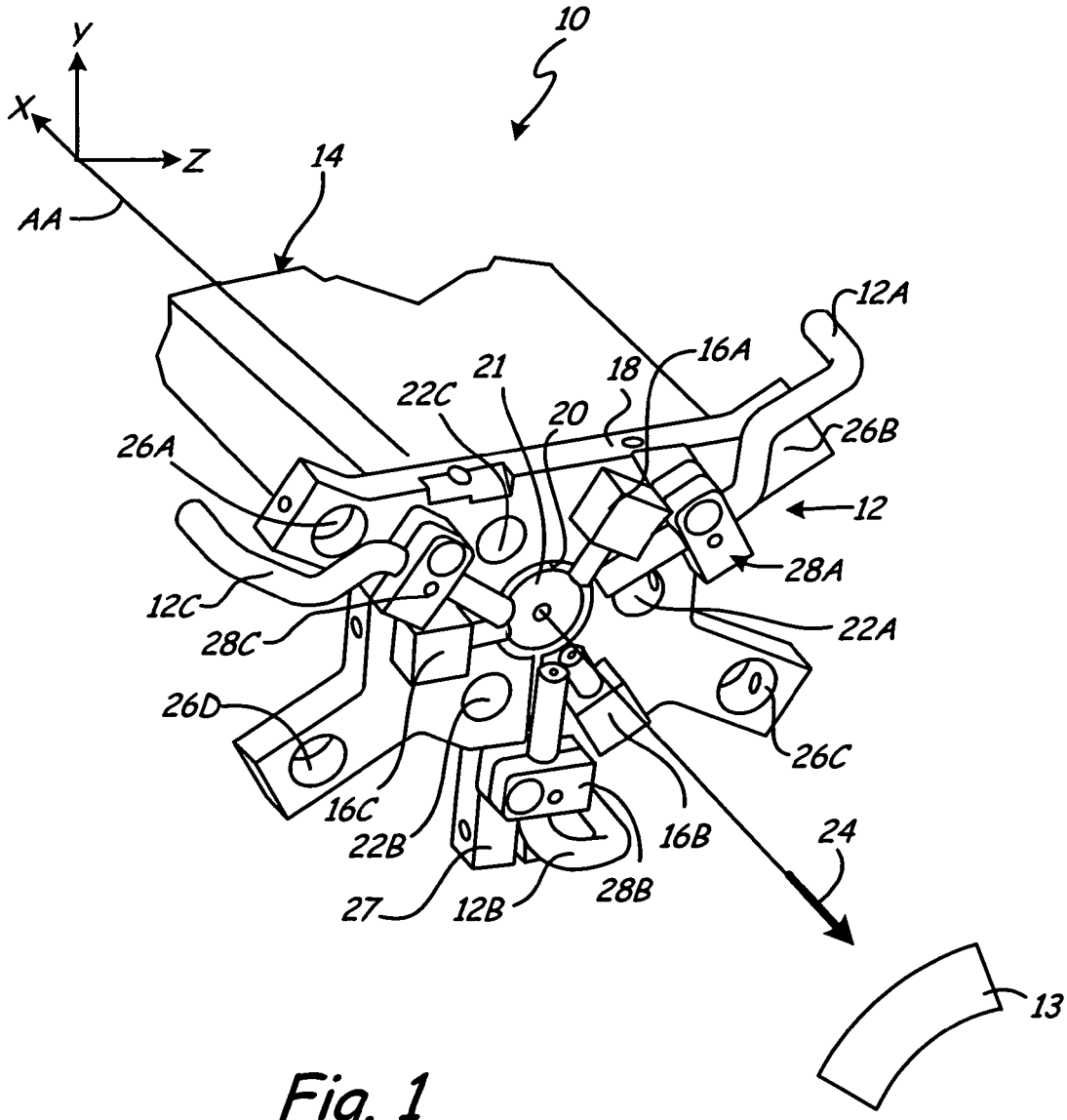
FIG. 1 shows a plasma powder coating faceplate in which the powder port blow-off system of the present invention is used.

FIG. 1 shows plasma powder coating system 10 in which powder port blow-off system 12 of the present invention is used. Plasma powder coating system 10 is used to spray a coating onto target part 13, and includes powder port blow-off system 12, plasma gun 14, and powder feed ports 16A, 16B and 16C, which are mounted on faceplate 18. Powder port blow-off system 12 includes blow-off 12A, blow-off 12B and blow-off 12C, which are secured to faceplate 18 with brackets 28A-28C, respectively. Faceplate 18 also includes plasma nozzle receiving bore 20 and powder port mounting features 22A, 22B and 22C for receiving additional powder ports. In embodiments, powder port mounting features 22A-22C are positioned slightly closer to bore 20 than the mounting features used to mount blow-offs 12A-12C. Faceplate 18 also includes cooling jet mounting features 26A, 26B, 26C and 26D, which may receive nozzles for directing air toward part 13 in order to cool part 13 and blow away loose powder or debris. Faceplate 18 is typically mounted to plasma nozzle 21 utilizing mounting pinch clamp 27 such that plasma nozzle 21 is co-axially aligned with nozzle receiving bore 20. However, in other embodiments, other attachment and locating components can be used to join plasma gun 14 with faceplate 18.

Plasma plume 24 is directed through nozzle 21 of plasma gun 14 and through receiving bore 20 of faceplate 18 along the x-axis. In embodiments, plasma gun 14 may be any suitable plasma spray torch known in the art. In other embodiments, plasma gun 14 may be substituted with any suitable powder coating apparatus used in other thermal spray processes. Plasma plume 24 comprises a stream of matter that is made up of gas that has been stripped of electrons by a high voltage arc, and is derived from any suitable gas, such as nitrogen provided from a pressurized source such as a compressed gas cylinder or compressor. As the gas of plasma plume 24 gathers free electrons and restabilizes, it reaches temperatures upwards of 30,000° F. As plasma plume 24 travels along the x-axis, powder ports 16A-16C spray a powderized coating material toward the x-axis such that plasma plume 24 becomes infused with coating material and is accelerated toward part 13. Thus, the powder coating material infused in plasma plume 24 heats or melts, and is projected toward part 13, whereby it sticks to part 13 forming a coating thereon.

In the embodiment shown, three powder ports (16A-16C) are used, however, any number of powder ports may be used. While the powderized coating material may comprise any suitable material or combinations of materials, in embodiments, the powderized coating material may comprise cobalt, nickel, aluminum, copper or plastic material, and can be infused with other property enhancing materials, such as a boron-based powder. Powder ports 16A-16C may also be used to spray ceramic powders, metallic alloying powders, or carbide powders in other embodiments of plasma spray coating system 10. While any suitable powder particle sizes may be used, in embodiments, powders having particle sizes ranging between about three to one hundred and fifty microns (~0.000118 to ~0.00591 inch) may be used. Each powder port 16A-16C is connected to a powder feeder, which typically utilizes compressed air or inert gas lines (which have been omitted on the figures for clarity) to inject the powder coating material into plasma plume 24. The powder coating material is projected at a velocity such that it penetrates plasma plume 24 sufficiently to melt or plasticize.

Plasma gun 14 is positioned relative to part 13 such that a uniform coating can be applied where specified during set-up of coating system 10. The specific gun-to-substrate distance is selected for each coating process, as well as other parameters such as powder feed rate and plasma power. The coating can be evenly applied to part 13 through coordinated movement of plasma gun 14 and part 13. Typically, plasma gun 14 traverses perpendicular to the x-axis on the y-axis, while part 13 is moved along the z-axis. In some coating processes, many parts can be suspended in a multi-tiered rotating rack, which allows multiple parts to be coated simultaneously. Part 13 can comprise any part suitable for plasma spray coating, which is typically a metallic part. For example, aircraft engine components, such as high-pressure compressor seals, are typically coated using plasma spray coating. The coating formed by the powder forms an exterior surface on part 13, which achieves a desirable physical or mechanical property. For example, abradable coatings are used to form a wearable layer that will gradually rub away when dragged across a mating surface, rather than causing damage to that part or its mating surface.

Powder port blow-off system 12 may use streams of compressed air to blow away excess coating powder that builds up on powder ports 16A, 16B and 16C. During the course of the spray process, it is inevitable that not all of the powder coating material will be consumed by plasma plume 24 or become part of the coating on part 13. Some of the powder will likely be projected onto other components of coating system 10, such as nozzle 21, blow-offs 12A-12C and powder ports 16A-16C, where it accumulates and eventually interferes with the coating process. Therefore, it is necessary to cease the process in order to clean faceplate 18 and its components, which results in slowed production times and wasted materials. Thus, powder port blow-offs 12A-12C may be used to blow away excess powder accumulation and reduce the rate at which powder accumulates on faceplate 18 and its components.

Blow-offs 12A-12C are arranged around faceplate 18 to direct a stream of compressed air or other gas toward faceplate 18 in a swirling vortex action to prevent or forcefully dislodge powder buildup on powder ports 16A-16C and faceplate 18 so that the powder can be collected with air filters. Powder port blow-offs 12A-12C are typically intermittently operated during a coating procedure when plasma plume 24 is directed away from part 13, as the flow of blow-off gas can interfere with powder injection. As such, blow-offs 12A-12C are not typically operated while plasma plume 24 is actively engaged in coating part 13, and instead blow-offs 12A-12C are typically operated only when plasma plume 24 is in between parts or in between passes. The blow-offs 12A-12C can be operated within system 10 with programmable logic controllers or other control types, if desired. In order to prevent high temperature plasma or heated particles from coming in contact with the powder ports or other components of gun 14 or faceplate 18, blow-offs 12A-12C are preferably arranged around nozzle 21 to direct air tangent to plasma plume 24.

FIG. 2 is a front view of faceplate 18 showing the arrangement of powder port blow-offs 12A, 12B and 12C, powder ports 16A-16C and powder port fixtures 22A-22C. Blow-offs 12A-12C are arranged around the circumference of receiving bore 20 such that they direct blow-off gas generally tangent to plasma plume 24 (or the x-axis). The nozzle of each blow-off 12A-12C is preferably directed across the tip of respective powder ports 16A-16C such that the bulk of the blow-off air intersects the sprayed powder coating away from the center of plasma plume 24 (or the x-axis). Faceplate 18 is shown having three powder ports 16A, 16B and 16C, with space for three additional powder ports at powder port mounting features 22A, 22B and 22C. In this embodiment, each powder port 16A-16C is spaced evenly from each other and from fixtures 22A-22C, radially around the circumference of plasma plume 24 with each of their nozzles directed toward the x-axis.

For example, in the embodiment shown, with reference to the compass created by the y-axis and the z-axis, powder port 16C is placed at, or otherwise mounted to faceplate 18, at approximately the 270° mark. Powder port 16A and 16B are spaced evenly therefrom, at approximately the 30° and 150° marks, respectively. Thus, powder ports 16A-16C are spaced about 120° apart. Additionally, powder port mounting feature 22A is placed at approximately the 90° mark, with powder port mounting features 22B and 22C spaced evenly therefrom, at approximately the 210° and 330° marks, respectively. Thus, powder port mounting features 22A-22C are also spaced about 120° apart from each other, and about 60° apart from powder ports 16A-16C. The powder ports are aligned in their mounting features to direct powder toward plasma plume 24, or the x-axis.

Each blow-off 12A-12C is positioned approximately 33° from one of powder ports 16A-16C. The 33° offset is the angle between the intersection of the powder port line of sight and the blow-off line of sight. (For illustrative purposes, blow-offs 12A-12C are at approximately the 63°, 183° and 303° marks, respectively. However, as is described below for FIG. 3, the blow-offs 12A-12C are arranged to direct blow-off gas tangent to plasma plume 24 and are thus not aligned truly along the 63°, 183° and 303° axis of the compass.) This arrangement also positions each blow-off 12A-12C approximately perpendicular to one powder port mounting feature 22A-22C. For example, blow-off 12A is about 33° from powder port 16A and approximately perpendicular to the line of sight of a powder port that would be mounted at powder port mounting feature 22C. This arrangement may assure that each powder port 16A-16C and each powder port mounting feature 22A-22C receives an adequate amount of blow-off gas such that excess powder is carried away.

Blow off pressures for each blow-off 12A-12C varies with each coating process and spray booth plumbing configuration, and in embodiments may range from about 35 psi (~241.3 kPa) to about 60 psi (~413.7 kPa). Blow-offs 12A-12C are positioned around the circumference of plasma plume 24 at an orientation with respect to powder ports 16A-16C such that they create a vortex of blow-off air into which coating powder not entrained in plasma plume 24 is sucked. As shown in FIG. 3, the tips of blow-offs 12A-12C touch the tips of powder ports 16A-16C.

FIG. 3 is a close-up of region A of FIG. 2 showing the configuration of the tips of powder port blow-off 12C and powder port 16C. Blow-off 12C is arranged around plasma plume 24 such that tip 30C of nozzle 32C for blow-off 12C is near the outer circumference of receiving bore 20. (The tips and nozzles of blow-offs 12A and 12B are arranged around receiving bore 20 in a like manner, but are not labeled as such in the figures.) As shown at point B, tip 30C is in contact with nozzle 34C of powder port 16C, and positioned a distance d from tip 36C of nozzle 34C. In one embodiment, distance d is 0.009 inches (~0.0229 cm), but any suitable distance d may be used. This also results in tip 30C being offset slightly from the center of plasma nozzle 20, such that the blow-off gas is directed tangent to plasma plume 24. The offset should be sufficient to ensure that tip 30C is not melted or otherwise damaged by plasma plume 24 when the blow-off air is activated by system 10.

FIG. 4 is cross-section 4-4 of faceplate 18 from FIG. 2 showing the in-plane configuration of powder port blow-offs 12A-12C. Powder port 16C is oriented in plane P relative to the face of faceplate 18, in which powder ports 16A and 16B are also aligned. Plane P is approximately parallel to the plane containing faceplate 18, or perpendicular to plasma plume 24. Blow-offs 12A-12C are also arranged to be in plane P such that they direct blow-off air perpendicular to the x-axis. Each blow-off is thus pushing air in the same plane in differing directions creating a swirling action around nozzle 21 and the x-axis. Plasma plume 24 travels along the x-axis perpendicular to plane P by the force of the expanding ionized gas. Plasma plume 24 combines with the compressed air of blow-offs 12A-12C to form vortex V. Thus, vortex V carries unconsumed powder particles out and away from faceplate 18 and nozzle 21. In order to properly form vortex V, the level or amount of blow-off air from each blow-off 12A-12C may be maintained at approximately equal levels. Thus, the blow-off gas can be controlled with a distribution block that equalizes the pressure in each blow-off gas line, if desired. It is preferable that the pressure in the gas lines does not create too powerful of a vortex, otherwise the vortex could suck powder material away from plasma plume 24. Thus, depending on the spray booth plumbing configuration and other variables, the pressure in system 10 is preferably checked to produce vortex V with enough power to blow away excess powder, but not to suck powder away from powder ports 16A-16C. The vortex action liberates accumulated powder from the components of coating system 10, which abates the necessity of manually cleaning faceplate 18 and thereby saves production time and expenses. Testing of coating system 10 has shown that shutdowns may only be required approximately every thirty-five to seventy spray cycles, a marked improvement over previous designs.

Although the present invention has been described with reference to preferred embodiments, workers skilled in the art will recognize that changes may be made in form and detail without departing from the spirit and scope of the invention.

The invention claimed is:

1. A powder port blow-off system for a plasma spray process, the powder port blow-off system comprising:

a faceplate comprising:

a plasma receiving bore that co-axially aligns with a plasma plume-emitting nozzle of a plasma spray gun; and at least one powder feed port for injecting a flow of powder particles perpendicularly into the plasma plume; and at least one powder port blow-off nozzle mounted to the faceplate to be co-planar with the powder feed port to direct a flow of blow-off air obliquely across the powder feed port and tangent to the plasma plume to create a helical vortex surrounding the plasma plume that travels from the faceplate axially along a length of the plasma plume and radially out from the plasma plume to carry away powder particles unconsumed by the plasma plume.

2. The powder port blow-off system of claim 1 wherein the system comprises three powder port blow-off nozzles.

3. The powder port blow-off system of claim 2 wherein all the powder port blow-off nozzles are equally pressurized with blow-off gas.

4. The powder port blow-off system of claim 2 wherein the faceplate includes a plurality of powder feed ports.

5. The powder port blow-off system of claim 4 wherein a plane containing the powder feed ports and the plurality of powder port blow-off nozzles is substantially parallel to the faceplate and that axial flows of blow-off air from the powder port blow-off nozzles are co-planar with axial flows of powder particles from the powder feed ports.

6. The powder port blow-off system of claim 5 wherein the three powder port blow-off nozzles are spaced equally circumferentially around the nozzle.

7. The powder port blow-off system of claim 6 wherein the powder port blow-off nozzles are disposed within the plane oblique to each other and the plurality of powder feed ports are disposed within the plane oblique to each other.

8. The powder port blow-off system of claim 1 wherein one powder port blow-off nozzle is directed toward the plasma plume at an angle offset circumferentially about thirty-three degrees from an angle at which a corresponding powder feed port is directed toward the plasma plume.

9. The powder port blow-off system of claim 8 wherein a tip of the powder port blow-off nozzle contacts the powder feed port about 0.09 inches away from a tip of the powder feed port.

10. A powder port blow-off system for a thermal spray process, the powder port blow-off system comprising:

a faceplate comprising:

a bore for receiving a nozzle that emits a powder coating propellant in an x-direction; and at least one powder feed port for injecting an axial flow of powder particles into the propellant in a y-z plane; and at least one powder port blow-off nozzle for producing an axial flow of gas in the y-z plane, and being oriented on the faceplate to direct the axial flow of gas obliquely across the at least one powder feed port and tangentially alongside the powder coating propellant to produce a vortex that co-axially surrounds the powder coating propellant and travels in the x-direction away from the faceplate for dislodging and carrying away powder particles not enveloped by the propellant.

11. The powder port blow-off system of claim 10 wherein the system comprises three powder port blow-off nozzles.

12. The powder port blow-off system of claim 11 wherein all the powder port blow-off nozzles are equally pressurized with blow-off gas.

13. The powder port blow-off system of claim 11 wherein the faceplate includes a plurality of powder feed ports.

14. The powder port blow-off system of claim 13 wherein the powder feed ports and the powder port blow-off nozzles are arranged in a plane substantially parallel to a plane containing the faceplate.

15. The powder port blow-off system of claim 14 wherein the three powder port blow-off nozzles are spaced equally circumferentially around the bore.

16. The powder port blow-off system of claim 15 wherein the powder port blow-off nozzles are disposed within the plane oblique to each other and the plurality of powder feed ports are disposed within the plane oblique to each other.

17. The powder port blow-off system of claim 10 wherein the plurality of powder port blow-off nozzles are directed toward the propellant at an angle offset circumferentially about thirty-three degrees from an angle at which corresponding powder feed port nozzles are directed toward the propellant.

18. The powder port blow-off system of claim 17 wherein a tip of each powder port blow-off nozzle contacts one powder feed port nozzle about 0.09 inches away from a tip of the powder feed port nozzle.

19. A powder port blow-off system for diverting excess powder coating particles away from a faceplate of a plasma spray coating process, the powder port blow-off system comprising:

a plurality of blow-off nozzles for projecting an axial flow of blow-off gas toward a plasma nozzle proximate the faceplate;

a plurality of powder spray ports for projecting an axial flow of powder towards the plasma nozzle;

wherein the axial flow of blow-off gas and the axial flow of powder are co-planar and the blow-off nozzles are offset at an angle from the powder spray ports to direct the flow of blow-off gas obliquely across the powder spray ports; and wherein the blow-off nozzles are positioned evenly around a circumference of the plasma nozzle in a plane including the powder spray ports such that the blow-off nozzles direct the flow of blow-off gas tangent to the plasma plume to create a vortex that co-axially travels and diverges along a length of the plasma plume in a direction away from the plurality of blow-off nozzles and the plurality of powder spray ports for diverting excess powder.

* * * * *